US011686502B2

(12) United States Patent
Kachelhoffer et al.

(10) Patent No.: US 11,686,502 B2
(45) Date of Patent: Jun. 27, 2023

(54) HEAT-GENERATING ELEMENT AND ELECTRIC HEATING DEVICE CONTAINING SUCH

(71) Applicant: Eberspächer catem GmbH & Co. KG, Herxheim (DE)

(72) Inventors: Patrick Kachelhoffer, Seebach (FR); Kurt Walz, Hagenbach (DE)

(73) Assignee: Eberspächer catem GmbH & Co. KG, Herxheim (DE)

( * ) Notice: Subject to any disclaimer, the term of this patent is extended or adjusted under 35 U.S.C. 154(b) by 574 days.

(21) Appl. No.: 16/828,338

(22) Filed: Mar. 24, 2020

(65) Prior Publication Data

US 2020/0309413 A1 Oct. 1, 2020

(30) Foreign Application Priority Data

Mar. 29, 2019 (DE) ..... 102019204472.7

(51) Int. Cl.
*F24H 9/1863* (2022.01)
*H05B 3/24* (2006.01)
*F24H 3/04* (2022.01)

(52) U.S. Cl.
CPC ..... *F24H 9/1872* (2013.01); *F24H 3/0464* (2013.01); *H05B 3/24* (2013.01);
(Continued)

(58) Field of Classification Search
CPC ..... F24H 9/1872; F24H 9/2028; F24H 9/103; F24H 9/1827; F24H 3/0464;
(Continued)

(56) References Cited

U.S. PATENT DOCUMENTS 4,445,026 A 4/1984 Walker
4,654,511 A * 3/1987 Horsma ..... H05B 3/146 219/548

(Continued)

FOREIGN PATENT DOCUMENTS

DE 272753 10/1989
DE 272754 10/1989

(Continued)

*Primary Examiner* — Shawntina T Fuqua
(74) *Attorney, Agent, or Firm* — Boyle Fredrickson S.C.

(57) ABSTRACT

A heat-generating element for an electric heating device includes a heating element casing which comprises a casing element formed from a ceramic material and a casing mating element formed from a ceramic material. The two casing elements bear against each other in a sealing manner and enclose, in a sealing manner between each other, a PTC element and conductor tracks. The conductor tracks bear, in an electrically conductive manner, against the PTC element and are assigned different polarities for energizing the PTC element. The heating element casing carries contact strips connected in an electrically conductive manner to the associated conductor tracks. At least one of the conductor tracks is formed by an electrically conductive element which is provided with through holes and which, in a height direction of the conductor track, comprises discrete points of support that bear against the PTC element and one of casing element and casing mating element. The present invention further relates to an electric heating device with at least one heater casing with a heat-generating element of the type described here that is arranged in a circulation chamber with a heating element casing joining at least one PTC element and contact strips energizing the PTC element as a structural unit. The heat generating element has the contact strips electrically connected to the PTC element projecting over itself. A partition wall separates the circulation chamber from a connection chamber of the heater casing. The contact strips
(Continued)

of the PTC heating element protrude through the partition wall and are exposed and electrically connected.

14 Claims, 2 Drawing Sheets

(52) U.S. Cl.
CPC .... *H05B 2203/016* (2013.01); *H05B 2203/02* (2013.01); *H05B 2203/023* (2013.01)

(58) Field of Classification Search
CPC ..... F24H 3/0429; F24H 1/09; H05B 3/24; H05B 3/04; H05B 3/50; H05B 3/10; H05B 3/286; H05B 3/32; H05B 3/06; H05B 3/265; H05B 3/22; H05B 3/02; H05B 3/03; H05B 3/14; H05B 3/12; H05B 3/141; H05B 3/0042; H05B 2203/02; H05B 2203/023; H05B 2203/016; H05B 1/0236; H05B 1/0244; B60H 1/2215; B60H 1/2225
See application file for complete search history.

(56) References Cited

U.S. PATENT DOCUMENTS

| | | | | |
|---|---|---|---|---|
| 4,833,305 | A | 5/1989 | Mashimo et al. | |
| 5,212,466 | A | 5/1993 | Yamada et al. | |
| 5,940,958 | A | 8/1999 | Shaw, Jr. et al. | |
| 7,064,301 | B2 * | 6/2006 | Han | F24H 3/0405 219/202 |
| 7,378,614 | B2 * | 5/2008 | Lee | H05B 3/50 219/202 |
| 9,560,697 | B2 | 1/2017 | Junghans et al. | |
| 10,429,099 | B2 | 10/2019 | Bohlender et al. | |
| 2011/0147370 | A1 | 6/2011 | Bohlender | |
| 2018/0160480 | A1 * | 6/2018 | Bohlender | H05B 3/06 |
| 2019/0311823 | A1 * | 10/2019 | Dubil | H05B 3/48 |
| 2021/0227633 | A1 * | 7/2021 | Bürkle | H05B 3/283 |

FOREIGN PATENT DOCUMENTS

| | | |
|---|---|---|
| DE | 102017209990 | 12/2018 |
| EP | 1768457 | 3/2007 |
| EP | 1916873 | 4/2008 |
| EP | 2873296 | 5/2015 |
| WO | 9941059 | 8/1999 |

* cited by examiner

HEAT-GENERATING ELEMENT AND ELECTRIC HEATING DEVICE CONTAINING SUCH

BACKGROUND OF THE INVENTION

1. Field of the Invention

The present invention relates to a heat-generating element and an electric heating device.

The present invention relates in particular to a heat-generating element for an electric heating device which is used in particular in a motor vehicle and must accordingly fulfill different requirements.

2. Background of the Invention

A heat-generating element for an electric heating device for a motor vehicle is known, for example, from DE 10 2017 209 990 A1.

In this prior art, the heating element casing consists of two casing elements which are joined to each other in a sealing manner. A PTC element is arranged within the heating element casing. The heating element casing also further encloses conductor tracks which are assigned different polarities and typically bear against oppositely disposed sides on the PTC element. These conductor tracks are electrically conductively connected to contact strips which are extended beyond an end side of the heating element casing and used for the electrical connection of the conductor tracks and therefore the heat-generating element to a power source.

Due to the self-regulating properties of PTC elements, a heat-generating element with such a PTC element should fulfill certain requirements. The heat should be decoupled on both main side surfaces of the PTC element. The main side surfaces of the PTC element are the largest surfaces of the PTC element. They are typically disposed parallel to each other and are connected by edge surfaces that either as a circumferential surface connect the main side surfaces, which is the case with round or oval PTC elements, or by face side surfaces with a straight extension, which is the case with rectangular block-shaped PTC elements.

Furthermore, a thermal path as good as possible between the outer surface dissipating heat from the heat-generating element and the PTC element should be present. In particular in high-voltage applications in an electrically operated motor vehicle, it is also necessary to electrically insulate the electrically conductive components of the heat-generating element in the interior of the casing element against the outer surface. The respective heating cell is commonly formed by the at least one PTC element and the conductor tracks that can be energized with different polarities as well as, possibly, connections to the conductor tracks of the contact strips projecting over the heating element casing on the outer side.

A heat-generating element is known from EP 1 916 873 A1 in which the conductor tracks in the form of contact plates are on the outer side covered with an insulating layer formed by a ceramic plate. The ceramic plate is there embedded into the heating element casing by way of injection mold coating a plastic frame in a manner sealing it at the edge. The heat-generating element thus formed be inserted directly into the flow of the fluid to be heated. It is particularly suitable as a heating element in a water heater.

EP 1 768 457 A1 or EP 2 873 296 A1 disclose solutions in which the electrical insulation is glued in the form of a multi-layer insulation onto a contact plate forming the conductor track.

However, though the above-mentioned embodiments provide the advantage that the contact plate as a conductor track together with the insulation needs to be joined to form a unit and that only this unit needs to be handled and installed in a positioning frame, a multi-layered structure arises from the PTC element to the heat-emitting outer surface. Each individual layer must be passed by the heat to be delivered to the exterior. Degraded heat transitions can arise at the phase boundaries which reduces the degree of efficiency of the PTC element, since the PTC element due to the self-regulating properties can no longer take up power in the absence of sufficient heat dissipation. The efficiency of the PTC element is then degraded.

SUMMARY

The present invention is based on the object of specifying a PTC element with an improved degree of efficiency.

To satisfy this object, the present invention specifies a heat-generating element for a motor vehicle. The heat generating element has a heating element casing which comprises a casing element formed from a ceramic material and a casing mating element formed from a ceramic material. The two casing elements bear against each other in a sealing manner and enclose, in a sealing manner between each other, a PTC element and conductor tracks. The conductor tracks bear in an electrically conductive manner against the PTC element and are assigned different polarities for energizing the PTC element. The heating element casing carries contact strips that are connected in an electrically conductive manner to the associated conductor tracks. At least one of the conductor tracks is formed by an electrically conductive element which is provided with through holes. In a height direction of the conductor track, the electrically conductive element comprises discrete points of support that bear against the PTC element and one of casing element and casing mating element.

The heat-generating element can then be arranged in a circulation chamber through which the medium to be heated flows. The heat can be decoupled from the heat-generating element directly via the outer surface of the heating element casing which is disposed as an exposed surface in the flow of fluid. In such an embodiment, for example, the heat-generating element is exposed as a kind of heating rib in a circulation chamber of an electric heating device, which is open only via hose connection ports for the fluid to be heated. The connection ports allow for pipes or hoses to be connected to the circulation chamber. Alternatively, the heat-dissipating outer surface of the heat-generating element can also be in contact with a radiator element whose heating ribs typically branch off substantially perpendicularly from the heat-dissipating outer surface of the heat-generating element and preferably bear directly thereagainst. The largest part of the heat dissipation of the heat generated by the PTC element is then effected by being passed into the heating ribs. In the case of a fluid heater first mentioned with connection ports, heat dissipation is effected only in a convective manner on the outer surfaces of the heating element casing.

The heating element casing according to the invention comprises a casing element and a casing mating element. The heating element casing is typically composed solely of the casing element and the casing mating element. Provided between the two casing elements is typically a sealing aid which abuts the two casing elements in a sealing manner against each other and/or connects them to each other. The sealing aid can be a weld seam, a strip of solder or a bead of adhesive. The sealing aid may be an adhesive introduced in a liquid state into a groove and cures, and may be crosslinked under heat action, but is thereafter permanently elastic. For example, silicone can be used as a sealing aid.

The sealing groove is there typically recessed in one of the casing elements, where another of the casing elements has a sealing web which engages in the sealing groove and which immerses in the sealing aid filled into the sealing groove. This creates a reliable seal of the interior of the heating element casing.

The casing element and the casing mating element may be formed from an identical material. This results in no relative misalignment during heating due to the operation of the heat-generating element and different coefficients of thermal expansion between the casing element and the casing mating element. The two casing elements are preferably formed from ceramic material, for example, aluminum oxide. They are typically produced in final contour by way of sintering.

The sealing groove is typically formed running circumferentially around the PTC element so that a fully circumferential seal for the PTC element arises. Of course, the sealing web is preferably also formed circumferentially and protrudes into the sealing groove with an end-to-end circumferential seal and is immersed into the sealing aid.

With regard to easy assembly, it is preferable to form one of casing element and casing mating element to be shell-shaped. Inserted in this casing element and joined during assembly of the heat-generating element are, firstly, the components of the heating cell before the other casing element, which is typically formed as a cover element, is placed onto the other casing element to complete the heat-generating element.

As mentioned above, at least one of the conductor tracks, typically both conductor tracks, is formed by an electrically conductive element provided with through holes. This electrically conductive element provided with through holes typically has contact points over the entire base surface which bear against the PTC element or the casing element, respectively. The points of support are each in a projection surface onto a main side surface of the PTC element typically provided offset. In the direction of projection, at most, a rather punctiform abutment against a surface of the PTC element or a surface of the casing element arises at a certain point. The corresponding discrete points of support improve the introduction of the power current onto the surface of the PTC element, where this surface is typically the main side surface of the PTC element.

The electrically conductive element provided with through holes can be a knitted fabric, a mesh or a fabric, each consisting of electrically conductive threads or fibers or at least comprising them. With regard to an extension of the current conduction path in the height direction of the PTC element, also electrically nonconductive threads or fibers can be incorporated, for example, in a mesh or fabric, in addition to such electrically conductive threads or fibers These threads can be made, for example, of polyamide or silicone. The material forming the electrically conductive threads or fibers can also be a plastic material that is formed to be electrically conductive. Alternatively, the electrically conductive element provided with through holes can be expanded metal. Also expanded metal has singular contact points in the height direction on the outer surface of the sheet of expanded metal sheet which can bear directly against the PTC element or the casing element.

The height direction is there to be understood to be the direction perpendicular to the planar extension of the conductor tracks. The points of support therefore protrude in the direction of the PTC element or the casing element, respectively, from the plane substantially containing or defining the conductor tracks. The through holes are typically formed end-to-end in the height direction in the conductor track. According thereto, a fabric is a fabric which in the direction of projection is transparent and has a relatively wide mesh, so that the points of support are provided with a certain spacing from each other. The spacing should be between 3 and 15 mm, preferably 5 and 10 mm.

With regard to good thermal conductivity between the main side surface of the PTC element and the outer surface of the heating element casing, defects within the electrically conductive element provided with through holes are filled with a heat-conducting mass, such as an adhesive mass. The adhesive mass can be filled with particles that conduct heat well to increase thermal conductivity. In any case, it is to be avoided that air remains between the inner surface of the heating element casing and the main side surface of the PTC element. The discrete points of support of the electrically conductive element provided with through holes are surrounded by the adhesive mass also in the circumferential direction and basically at the level of the surface of the heating element casing or PTC element, respectively. The adhesive mass should furthermore surround the face side surfaces of the PTC element also at the edge surfaces of the heating element casing in view of heat dissipation, and fill a clearance between these face side surfaces and the oppositely disposed inner surfaces of the heating element casing. Heat can then be dissipated from the heating element casing in all directions and not only in the direction perpendicular to the main side surface of the PTC element.

According to a preferred further development of the present invention, the conductor track is extended at the edge beyond the main side surfaces of the PTC element. To compensate for manufacturing tolerances, the conductor track preferably projects over the PTC element over the entire contour.

The conductor track and the contact strip associated with the conductor track may be formed by a uniform electrically conductive element provided with through holes. For the formation of the contact strip and the associated conductor track, only this one electrically conductive element with through holes must be cut to size in order to provide a bearing surface to the PTC element and a contact at the outer side of the heating element casing. The contact strip is formed by a flat piece that forms the male contact element of a plug connection.

If the heating element casing is made of ceramic material, this typically comprises passage openings on a frame strut, over which the heat-generating element is inserted in a sealing manner into a partition wall which is formed as part of a heater casing and which defines the circulation chamber and on the opposite side of the partition wall forms a connecting chamber in which the contact strips of the heat-generating element are electrically connected.

For this passing of the contact strips, one of the casing elements is preferably provided with a flange which generally forms the two passage openings for the contact strips. A flange is to be understood to be a thickening of the frame strut in the height direction of the PTC element. This flange is typically formed by the shell-shaped casing element.

BRIEF DESCRIPTION OF THE DRAWINGS

Further details and advantages of the present invention shall become apparent from the following description of an embodiment in combination with the drawing, in which.

DETAILED DESCRIPTION

Figure 1:
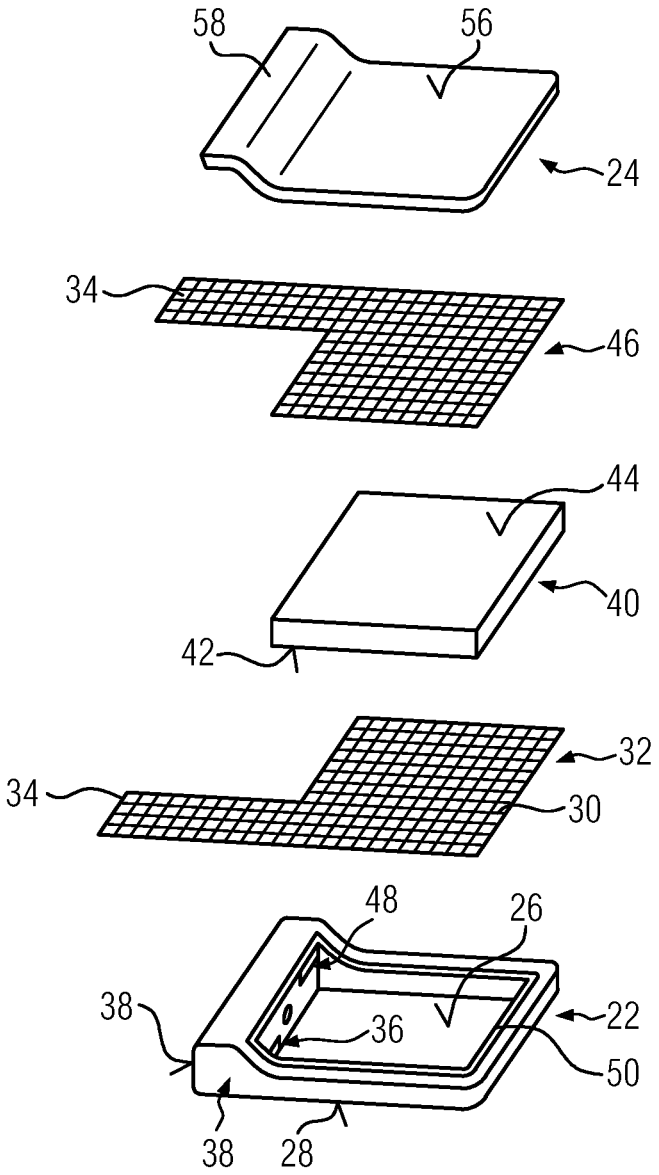
FIG. 1 shows a perspective explosion representation of an embodiment of the heat-generating element according to the invention

FIG. 1 shows all the components of the embodiment of a heat-generating element which are prepared with a predetermined geometry and configuration for the creation of the heat-generating element.

Figure 2:
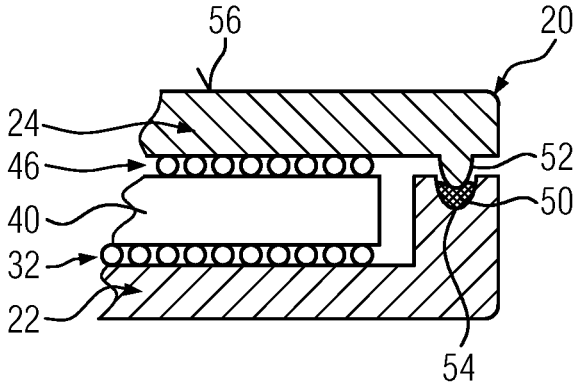
FIG. 2 shows a sectional view of the embodiment shown in FIG. 1

The heat-generating element in FIG. 2 marked with reference numeral 20 has a heating element casing 21 which is formed by a shell-shaped casing element 22 and a flat casing mating element 24 formed like a kind of cover. The shell-shaped casing element 22 has a base 26 (cf. FIG. 1) which is formed in a planar manner and with its outer surface 28 defines a heat-dissipating outer surface of the heating element casing which runs plane-parallel to the inner side of the base 26. A metal fabric marked with reference numeral 30 as an embodiment of an electrically conductive element provided with through holes is placed on this base 26. This metal fabric 30 as a uniform component forms a conductor track 32 and a planar and flat contact strip 34 associated with the conductor track 32. The conductor track 32 bears against the base 26 of the casing element 22. The conductor track 32 protrudes through a passage opening 36 which is recessed in a flange 38 of the casing element 22.

Reference numeral 40 indicates a rectangular block-shaped PTC element whose main side surfaces 42, 44 are contacted by associated metal fabrics 30. A conductor track marked with reference numeral 46 is formed to be identical to the previously described conductor track 32, but placed inverted onto the PTC element 40, so that the latter's contact strip 34 is led out through the flange 38 in the longitudinal direction of the flange 38 offset relative to the other contact strip 34. The flange 38 forms a passage opening 48 also for this purpose. The corresponding arrangement of the contact strips 34 increases the air and creep distance between the two polarities which are associated with the conductor tracks 32, 46 inside and outside the heating element casing 22, 24.

The shell-shaped casing element 22 has a circumferential sealing groove marked with reference numeral 50. As illustrated by the detail of the sectional representation according to FIG. 2, a sealing web 52 engages in this sealing groove 50. The sealing web 52 is immersed in permanently elastic adhesive 54, so that a circumferential seal of the interior of the heating element casing 42, 24 receiving the PTC element 40 and the conductor track 32 is created.

The two casing elements 22, 24 are made of aluminum oxide. These are sintered parts produced in final contour.

The two casing elements 22, 24 are evidently shaped in such a way that the outer surfaces 28, 56 formed by these casing elements 22, 24 comprise a projection surface to the main side surface 44 or 42 the PTC element 40, respectively, which is plane-parallel to these main side surfaces 42, 44. The heat dissipation from the heating element casing 22, 24 can be effected directly adjacent to the main side surface 42 or 44 to the PTC element. The heat dissipated from the main side surfaces 42, 44 of the PTC element 40 therefore in a direction perpendicular to the main side surfaces 42, 44 passes through only thin flat layers to reach the outer surface 56.

The abutment segment 58 of the casing element 24 adapted to the contour of the flange 38 lies beyond a projection surface onto the PTC element 40. In other words, in a top view onto the outer surface 56 or 58, respectively, the PTC element 40 is located laterally next to the flange or the flange 38 or the abutment segment 58, respectively. For the production of the embodiment shown, the two casing elements 22,24 are first produced as sintered parts. First, the shell-shaped casing element 22 is provided with the metal fabric 30. Its contact strip 34 is passed through the passage opening 36. Before the placement onto the metal fabric 30, a predetermined amount of adhesive material is typically first applied over the surface onto the base 36 of the casing element 22. After the metal fabric 30 has been inserted into the casing element 22, the PTC element 40 is inserted. The PTC element is there pressed against the metal fabric 30, so that the discrete points of support formed by the metal fabric 30 are abutted against the surface of the PTC-element 40 in an electrically conductive manner. In a corresponding manner, the points of support are abutted directly against the base 26 in a heat-conductive manner. The adhesive is there displaced. It fills a gap between the circumferential surface of the PTC element 30 and the edge surrounding the base 24 and formed by the casing element 22.

The adhesive is applied to the free upper side of the TPC element 40. Here as well, the application of the adhesive is effected as much over the surface as possible. The contact strip 34 of the further metal fabric 30 is subsequently inserted into the passage opening 48 provided for this. Also, the further conductor track 46 is for direct electrical contact of the PTC element at its main side surface 44 pressed against the same, thus displacing the adhesive. When applying the adhesive to the PTC element 40, the former can also be introduced into the sealing groove 50. The adhesive used within the heating element casing 22, 24 can be identical to the adhesive that connects the two casing elements 22, 24 to each other and seals them against each other. Introducing the adhesive between the metal fabric 30 and the two casing elements 22, 24 results in a firm connection between the casing elements 22, 24 and a holding function between them by introducing the adhesive into the sealing groove 50.

The casing element 24 is finally mounted, whereby the sealing web 52 is introduced into the sealing groove 50. This results in circumferential sealing of the PTC element 40.

Thereafter, pressure is applied typically from the outside against the outer surface 28 or 56, respectively, of the casing elements 22, 24 to ensure that the conductor tracks 32, 46 directly contact the associated inner surfaces of the casing elements 22, 24 and the main side surfaces 42, 44 of the PTC element 40 when the adhesive cures.

Curing takes place under this external pressure at an increased temperature, so that the adhesive can cross-link faster. For this purpose, the heat-generating element can be electrified and thus heated.

Figure 3:
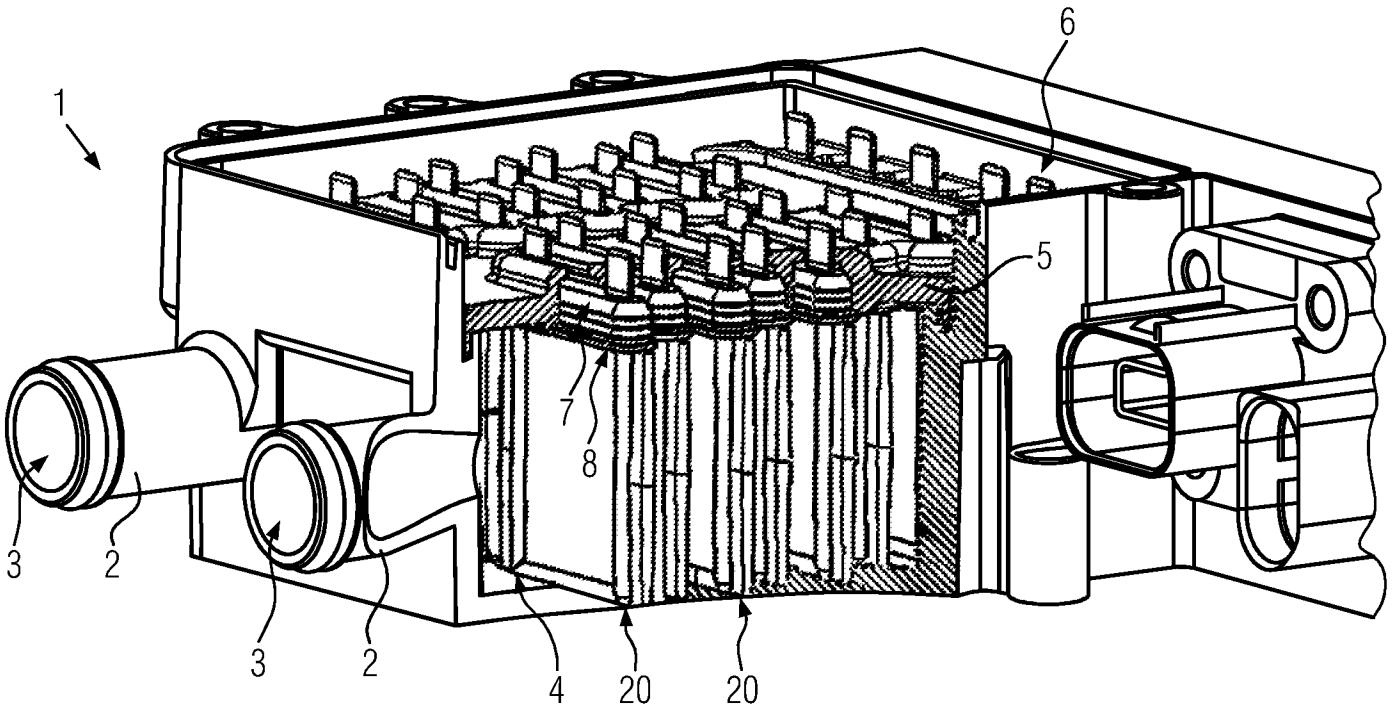
FIG. 3 shows a perspective partially cut-out representation of an electric heating device which receives several embodiments of the heat-witnessing element.

The accommodation of the embodiment of the heat-generating element discussed with reference to FIGS. 1 and 2 in an electric heating device of a motor vehicle is illustrated in FIG. 3.

The electric heating device has a heater casing 1 made of plastic material and marked with reference numeral 1. The casing 1 forms inlet and outlet ports 2 which each define inlet or outlet openings 3, respectively, which lead to a circulation chamber 4 which is via a cover 5 separated in a fluid-tight manner from a connection chamber marked with reference numeral 6 and forms receptacles 7 which are formed as female plug elements of a fluid-tight plug connection which is effected by insertion of a sealing collar 8 into the receptacle 7. The sealing collar 8 is there formed circumferentially around the flange 38 and the abutment segment 58. The sealing collar 8 typically consists of a resiliently soft plastic material, in particular silicone. The sealing collar 8 can be formed by injection mold coating the heat-generating element 20. The flange 38 and the abutment segment 58 can have configurations formed in an adapted manner which lead to improved sealing and/or holding of the sealing collar 8 on the heat-generating element 20.

In the position shown in FIG. 3, the contact strips 34 with their exposed ends protrude into the connecting chamber 6 and can there be electrically connected, as this is basically described in EP 3 334 244 A1. In the example presently shown, the cover 5 forms the partition wall which seals the circulation chamber 4 in a fluid-tight manner against the connection chamber 6 and forms the receptacles 7. In the embodiment shown, cover 5 is inserted as a separate component made of plastic material into the heater casing. Other configurations are also conceivable, in which, for example, a base of the heater casing 1 is formed as a separate cover element and the cover 5 together with the walls of the heater casing 1 defining the connecting chamber 6 or the circulation chamber 4, respectively, and extending substantially perpendicular to the base are formed integrally.

We claim:

1. A heat-generating element for a motor vehicle comprises: a heating element casing which comprises a casing element formed from a ceramic material and a casing mating element formed from a ceramic material, wherein the two casing elements bear against each other in a sealing manner and enclose, in a sealing manner between each other, a PTC element and conductor tracks, wherein the conductor tracks bear, in an electrically conductive manner, against the PTC element and are assigned different polarities for energizing the PTC element, wherein the heating element casing carries contact strips connected in an electrically conductive manner to the associated conductor tracks, and wherein at least one of the conductor tracks is formed by an electrically conductive element which is provided with through holes and which, in a height direction of the conductor track, comprises discrete points of support that bear against the PTC element and one of casing element and casing mating element.

2. The heat-generating element according to claim 1, wherein the electrically conductive element is a mesh, a knit fabric, or a fabric, each comprising or consisting of electrically conductive threads or fibers, or is an expanded metal.

3. The heat-generating element according to claim 1, wherein the through holes are filled with an adhesive mass.

4. The heat-generating element according to claim 1, wherein that at least one of the casing elements is formed to be shell-shaped.

5. The heat-generating element according to claim 1, wherein one of casing element and the casing mating element comprises a circumferential sealing groove, wherein the other of casing element and casing mating element comprises a sealing web engaging in the sealing groove, and wherein the sealing web is immersed in a sealing aid filled into the sealing groove.

6. The heat-generating element according to claim 1, wherein the conductor track and the associated contact strip are formed by a uniform electrically conductive element provided with through holes.

7. The heat-generating element according to claim 1, wherein one of the casing elements forms a flange through which the contact strips protrude.

8. The heat-generating element according to claim 1, wherein the projection surface of one of the main side surfaces of the PTC element onto the outer surfaces of the casing element runs plane-parallel to the main side surface of the PTC element.

9. The heat-generating element according to claim 1, wherein the electrically conductive element is a mesh, a knit fabric, or a fabric, each comprising or consisting of electrically conductive threads or fibers, or is expanded metal and that the through holes are filled with an adhesive mass.

10. The heat-generating element according to claim 1, wherein at least one of the casing elements is formed to be shell-shaped, and wherein one of casing element and casing mating element comprises a circumferential sealing groove, wherein the other of casing element and casing mating element comprises a sealing web engaging in the sealing groove, and wherein the sealing web is immersed in a sealing aid filled into the sealing groove.

11. The heat-generating element according to claim 10, wherein one of the casing elements forms a flange through which the contact strips protrude.

12. The heat-generating element according to claim 11, wherein the conductor track and the associated contact strip are formed by a uniform electrically conductive element that is provided with through holes.

13. An electric heating device comprising:

at least one heater casing with a heat-generating element arranged in a circulation chamber, a heating element casing joining at least one PTC element and the PTC element and contact strips as a structural unit, wherein the contact strips are electrically connected to the PTC element projecting over itself, a partition wall separating the circulation chamber from a connection chamber of the heater casing in which the contact strips of the PTC heating element that protrude through the partition wall are exposed and electrically connected, and wherein the heat-generating element comprises a heating element casing which comprises a casing element formed from a ceramic material and a casing mating element formed from a ceramic material, wherein the two casing elements bear against each other in a sealing manner and enclose, in a sealing manner between each other, a PTC element and conductor tracks, wherein the conductor tracks bear, in an electrically conductive manner, against the PTC element and are assigned different polarities for energizing the PTC element, wherein the heating element casing carries contact strips connected in an electrically conductive manner to the associated conductor tracks, and wherein at least one of the conductor tracks is formed by an electrically conductive element which is provided with through holes and which, in a height direction of the conductor track, comprises discrete points of support that bear against the PTC element and one of casing element and casing mating element.

14. The electric heating device according to claim 13, wherein the heat-generating element is inserted into the partition wall in a sealing manner.

* * * * *